US006016951A

United States Patent [19]

Correll

[11] Patent Number: 6,016,951

[45] Date of Patent: Jan. 25, 2000

[54] PIZZA BOX WITH ROLL-OVER EXPANDABLE WALL SECTION

[76] Inventor: John D. Correll, 8459 Holly Dr., Canton, Mich. 48187

[21] Appl. No.: 09/141,930

[22] Filed: Aug. 28, 1998

Related U.S. Application Data

[63] Continuation-in-part of application No. 08/731,586, Oct. 16, 1996, Pat. No. 5,833,130, which is a continuation-in-part of application No. 08/311,396, Sep. 23, 1994, Pat. No. 5,713,509.

[51] Int. Cl.[7] ..... B65D 5/22

[52] U.S. Cl. ..... 229/101; 229/109; 229/178; 229/906

[58] Field of Search ..... 229/101, 109, 229/110, 178, 902, 906

[56] References Cited

U.S. PATENT DOCUMENTS

| | | | |
|---|---|---|---|
| 4,765,534 | 8/1988 | Zion et al. | 229/109 |
| 5,000,374 | 3/1991 | Deiger | 229/109 |
| 5,110,039 | 5/1992 | Philips | 229/110 |
| 5,118,032 | 6/1992 | Geho | 229/110 |
| 5,211,329 | 5/1993 | Patton | 229/110 |
| 5,535,940 | 7/1996 | Olds | 229/110 |
| 5,553,771 | 9/1996 | Correll | 229/110 |
| 5,586,716 | 12/1996 | Correll | 229/110 |
| 5,595,339 | 1/1997 | Correll | 229/109 |
| 5,713,509 | 2/1998 | Correll | 229/109 |
| 5,823,421 | 10/1998 | Shilcock | 229/101 |
| 5,833,130 | 11/1998 | Correll | 229/906 |
| 5,918,797 | 7/1999 | Correll | 229/906 |

FOREIGN PATENT DOCUMENTS

| | | | |
|---|---|---|---|
| 2116150 | 9/1980 | United Kingdom | 229/109 |

*Primary Examiner*—Gary E. Elkins

[57] ABSTRACT

A non-rectangular, non-collapsible, expandable box having a roll-over expandable wall section comprising a roll-over wall structure, a single-panel wall structure, and an angle-changeable wall structure. The roll-over wall structure comprises parallel inner and outer wall panels, the single-panel wall structure comprises a wall panel and a corner flap panel attached thereto, and the angle-changeable wall structure comprises a plurality of foldline-connected movable panels that is movable from a first disposition to a second disposition. A method of use is associated with the box. The primary purpose of the box is for packaging pizza and similar products.

23 Claims, 4 Drawing Sheets

10
47
48
43
44
42
41
45
40
46
108
106
30
80a
83a
82a
21
81a
26
25
101
23
20
24
71
29
70
65
27
28
72
61
22
90
62
60
64
63
91
92
50a

PIZZA BOX WITH ROLL-OVER EXPANDABLE WALL SECTION

CROSS-REFERENCES TO RELATED APPLICATIONS

This is a continuation-in-part application of my application Ser. No. 08/731,586, entitled "Multi-function Pizza Carton," filed on Oct. 16, 1996, now U.S. Pat. No. 5,833,130 which is a continuation-in-part of my application Ser. No. 08/311,396, entitled "Convertible Box," filed on Sep. 23, 1994, now U.S. Pat. No. 5,713,509.

FIELD OF THE INVENTION

This invention relates to boxes and blanks made of foldable material and, in particular, to expandable cartons for relatively flat food products such as pizza and the like.

DESCRIPTION OF THE PRIOR ART

My application Ser. No. 08/731,586 (Multi-function Pizza Carton) and my application Ser. No. 08/311,396 (Convertible Box), now U.S. Pat. No. 5,713,509, each disclose a box having a roll-over expandable wall section. Both applications also disclose a method of use for the box.

The invention disclosed herein is a combination of the aforementioned inventions and also an enhancement thereof. Although this invention can be used for numerous purposes, it is intended particularly for use in packaging pizza.

In the pizza industry, a need exists for a carton that provides material savings over the standard square pizza box which has a roll-over front wall. (A roll-over wall is a double-panel wall comprising parallel inner and outer panels joined along a top edge). A lesser need also exists for a carton with diagonal walls to reduce slice-sliding during delivery. In response to those needs, a number of non-rectangular, material-saving cartons have emerged. Examples include: Zion et al. U.S. Pat. No. 4,765,534 granted Aug. 23, 1988; Deiger U.S. Pat. No. 5,000,374 granted Mar. 19, 1991; Philips U.S. Pat. No. 5,110,039 granted May 5, 1992; Geho U.S Pat. No. 5,118,032 granted Jun. 2, 1992; and Patton U.S. Pat. No. 5,211,329 granted May 18, 1993.

In addition, a need exists for a carton that allows easier box-loading and in-box pizza-cutting. (A detailed description of those functions can be found in my application Ser. No. 09/002,153, entitled "Expandable Pizza Box and Method of Use.") In response, a few pizza companies have adopted a folder style, or collapsible, carton. This type of carton has fully-reclinable walls, or walls that fall outward and can be layed flat when the cover is open. This feature enables a pizza to be easily loaded into the box and easily cut therein. Examples of this type of box in a non-rectangular format include Zion et al '534, Deiger '374, and Philips '039.

However, while a folder style box facilitates easier box-loading and in-box pizza-cutting, it can also incur functional drawbacks. Specifically, it can require an unfamiliar and often awkward folding procedure that some pizza companies dislike. In addition, some folder style boxes can incur one or more structural drawbacks such as reduced box rigidity, loose cover closure, or reduced stacking strength. To overcome these potential problems, a box with a permanently-upright roll-over wall structure can be beneficial. This type of box is referred to as a "non-collapsible" box. The widely-used standard square pizza box with connected front corners and roll-over front wall is an example. Patton '329 is an example of a non-rectangular, non-collapsible box with roll-over wall structures.

So there has remained a need in the pizza industry for a box that combines (a) the material savings of a non-rectangular box with (b) the familiar folding procedure of a box having roll-over wall structure with (c) the pizza-loading and pizza-cutting ease of a folder-style box with (d) the functionality and structural attributes of a non-collapsible box having roll-over wall structure.

In conclusion, it would be highly desirable to have a box that addresses all of the above-described needs in combination and, thereby, overcomes the above-described problems. Those problems have not been completely resolved by the prior art but are addressed by my invention.

OBJECT AND ADVANTAGE

Accordingly, the object of my invention is a pizza box that (a) can be made with less material than the standard square pizza box, (b) has a familiar folding procedure similar to that of the standard pizza box, (c) incorporates one or more desirable performance functions of non-collapsible boxes, and (d) has the positive structural attributes of a box having roll-over wall structure. To accomplish this, my invention is a non-rectangular, non-collapsible, expandable pizza box having a roll-over expandable wall section. In using the box, it can be put into first and second dispositions, thereby imbuing the box with enhanced functionality.

The advantage of my invention is that it combines the best features of various boxes. Specifically, it provides the cost savings of a non-rectangular box, the familiar folding procedure of the standard square pizza box, some of the user functionality (i.e., easier box-loading and in-box pizza-cutting) of a folder style or collapsible box, and the structural attributes (i.e., rigidity, cover-closure, and stacking strength) of a non-collapsible box having roll-over wall structure.

Further objects and advantages of the invention will become apparent from consideration of the following detailed description, related drawings, and appended claims.

SUMMARY OF THE INVENTION

My invention is a non-rectangular, non-collapsible, expandable box that has at least one roll-over expandable wall section. The roll-over expandable wall section is formed from a combination of three structures: (1) a roll-over wall structure comprising parallel inner and outer panels, (2) a single-panel wall structure comprising a wall panel and a corner flap panel attached thereto and disposed between the inner and outer panels, and (3) an angle-changeable wall structure comprising a plurality of foldline-connected movable panels with a first movable panel hingedly attached to either the roll-over wall structure or the single-panel wall structure.

The angle-changeable wall structure is movable from a first disposition to a second disposition and vice versa. As such, there is a method of use associated with the box, which involves moving the angle-changeable wall structure from one disposition to another. The first disposition results in a box cavity of expanded size, which can possibly provide a certain functional advantage such as easier box-loading or easier in-box pizza-cutting, and the second disposition results in a box cavity of contracted size, which can possibly provide a structural advantage such as enhanced box rididity, tighter cover closure, or greater stacking strength.

My invention typically would be used for packaging relatively flat food products such as pizza; however, it could be used for other purposes, as well.

A complete understanding of the invention can be obtained from the detailed description that follows.

LIST OF REFERENCE NUMERALS

Figure 1:
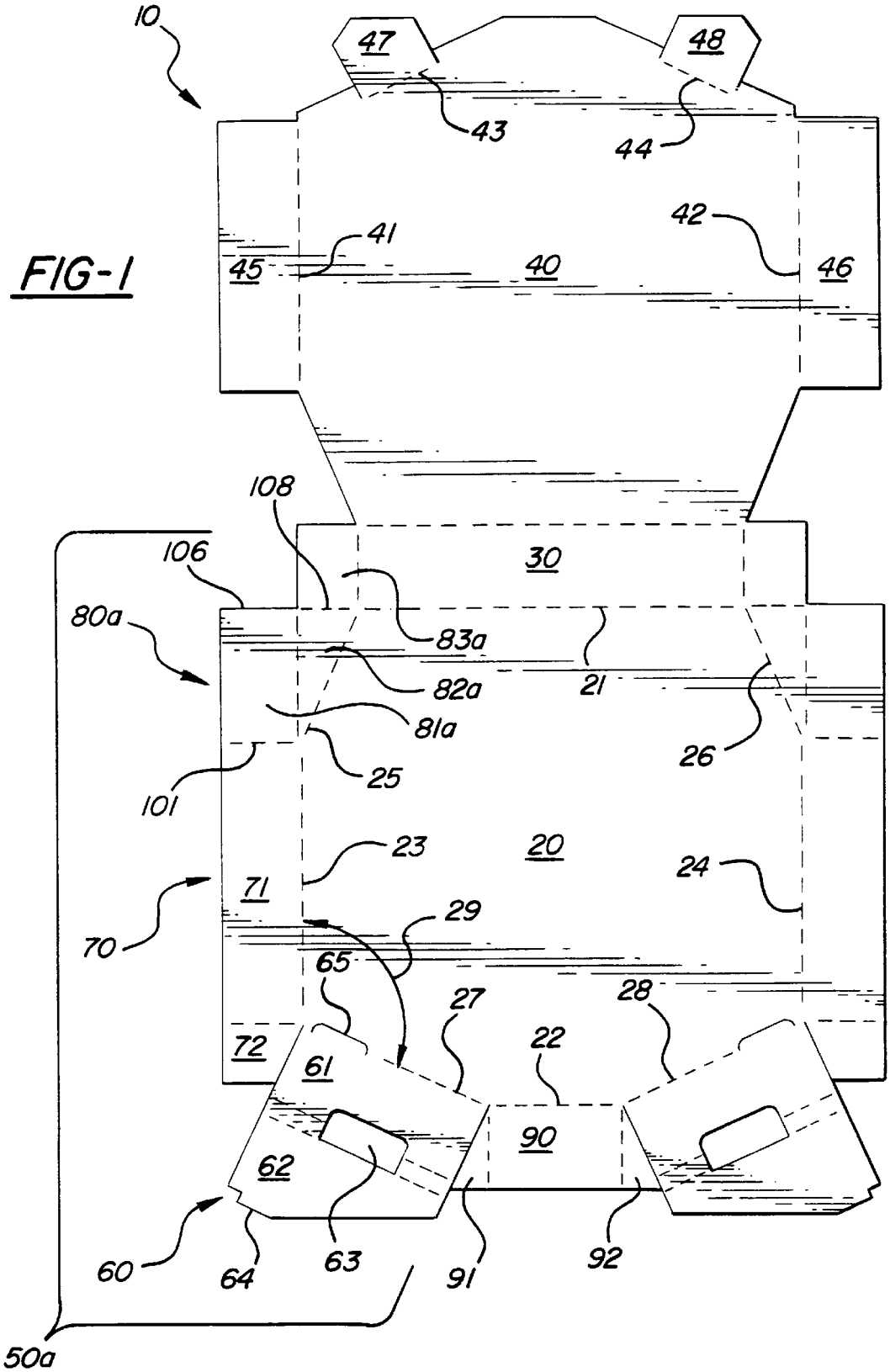
FIG. 1 is a plan view of a blank of the first preferred embodiment of the invention.

Within a drawing, closely related components have the same number but different alphabetic suffixes. Between drawings, like reference numerals designate corresponding parts.

| | |
|---|---|
| 10 | blank of first embodiment |
| 12 | box of first embodiment |
| 14 | blank of second embodiment |
| 16 | box of second embodiment |
| 20 | bottom panel |
| 21 | rear end edge |
| 22 | front end edge (bottom edge of panel 82b) |
| 23 | left side edge |
| 24 | right side edge |
| 25 | left rear diagonal edge |
| 26 | right rear diagonal edge |
| 27 | left front diagonal edge (bottom edge of outer panel) |
| 28 | right front diagonal edge |
| 29 | angle |
| 30 | rear wall panel |
| 40 | cover panel |
| 41 | side edge |
| 42 | side edge |
| 43 | front diagonal edge |
| 44 | front diagonal edge |
| 45 | cover side flap |
| 46 | cover side flap |
| 47 | cover front diagonal flap |
| 48 | cover front diagonal fiap |
| 50a | roll-over expandable wall section |
| 50b | roll-over expandabie wall section |
| 60 | roll-over wall structure |
| 61 | outer panel |
| 62 | inner panel |
| 63 | cover interlock means |
| 64 | bottom edge tab |
| 65 | slot |
| 70 | single-panel wall structure |
| 71 | wall panel |
| 72 | corner flap panel |
| 80a | angle-changeable wall structure |
| 80b | angle-changeable wall structure |
| 81a | first movable panel |
| 81b | first movable panel |
| 82a | second movable panel |
| 82b | second movable panel |

-continued

| | |
|---|---|
| 83a | third movable panel |
| 83b | third movable panel |
| 90 | front wall panel |
| 91 | corner flap panel |
| 92 | corner flap panel |
| 101 | end of wall panel |
| 102 | end of outer panel |
| 104 | side edge of panel 82b |
| 106 | end edge of panel 81a |
| 108 | bottom edge of panel 83a |
| 110 | angle |
| 112 | angle |
| 120 | alternate top edge of corner flap panel |

DESCRIPTION OF THE PREFERRED EMBODIMENTS

Referring now to the drawings, there is illustrated two preferred embodiments of the invention in blanks made of corrugated paperboard and, correspondingly, boxes created from the blanks. The intended use for the embodiments is as hot food cartons or, specifically, pizza boxes. However, it will be appreciated, as the description proceeds, that my invention may be realized in other embodiments and may be used in other applications.

Figure 2:
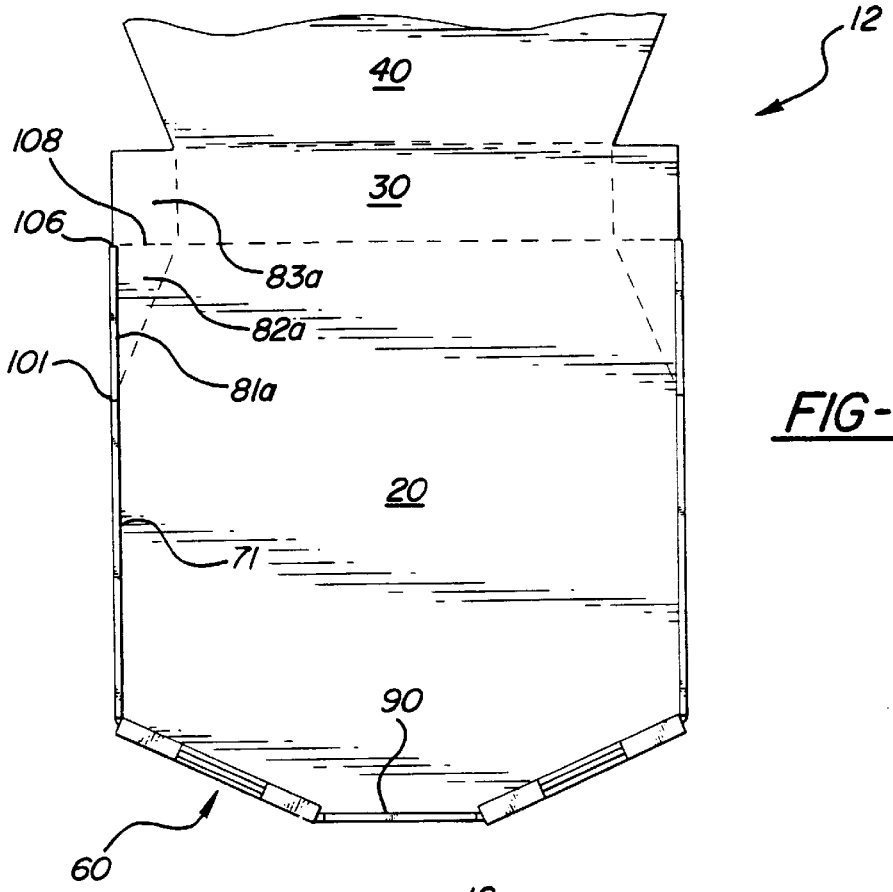
FIG. 2 is a top view of an open carton formed from the blank of FIG. 1, with the angle-changeable wall structures being in first disposition.
Figure 3:
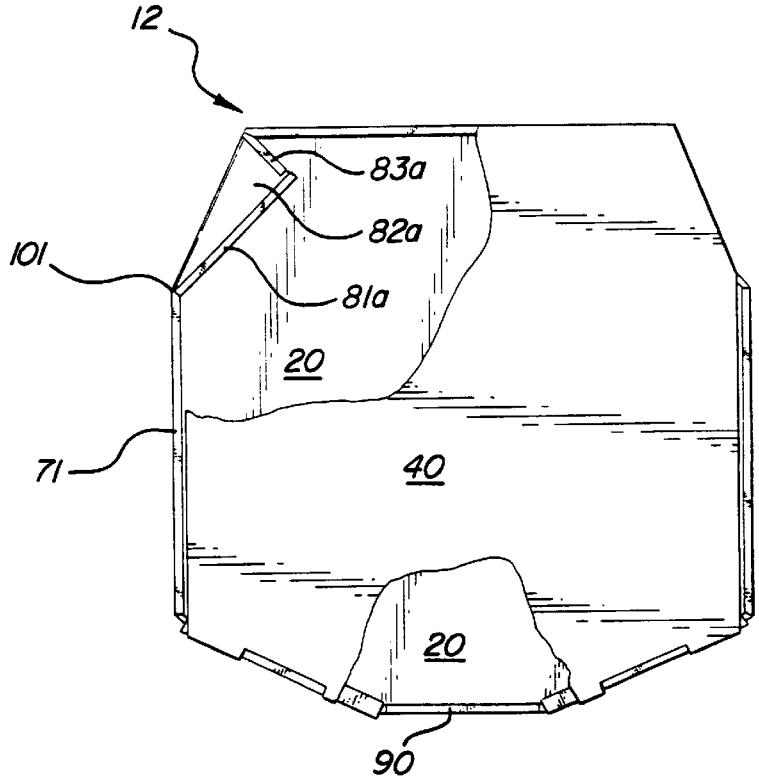
FIG. 3 is a top view of a closed carton formed from the blank of FIG. 1, with the angle-changeable wall structures being in second disposition.
Figure 4:
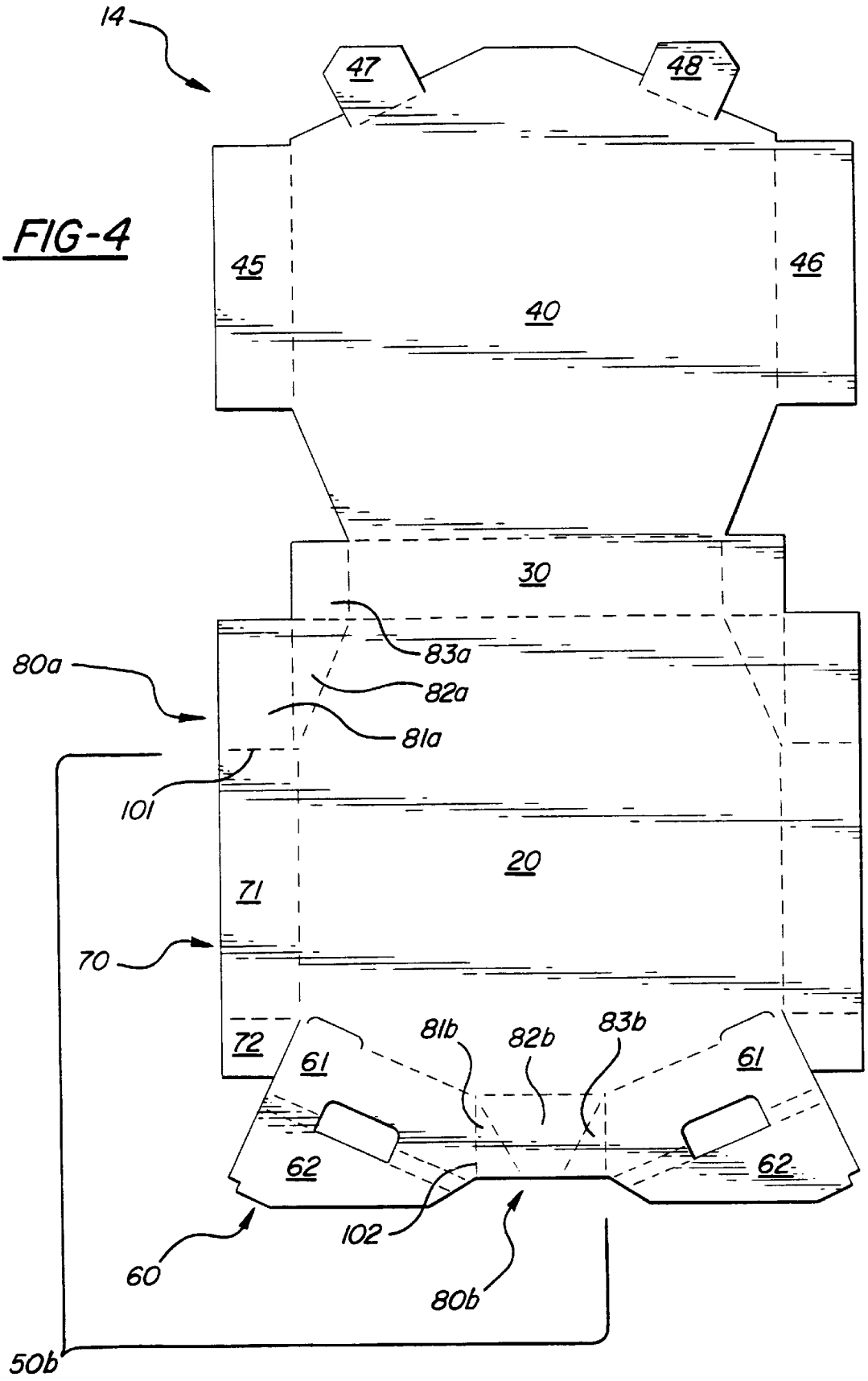
FIG. 4 is a plan view of a blank of the second preferred embodiment of the invention.
Figure 6:
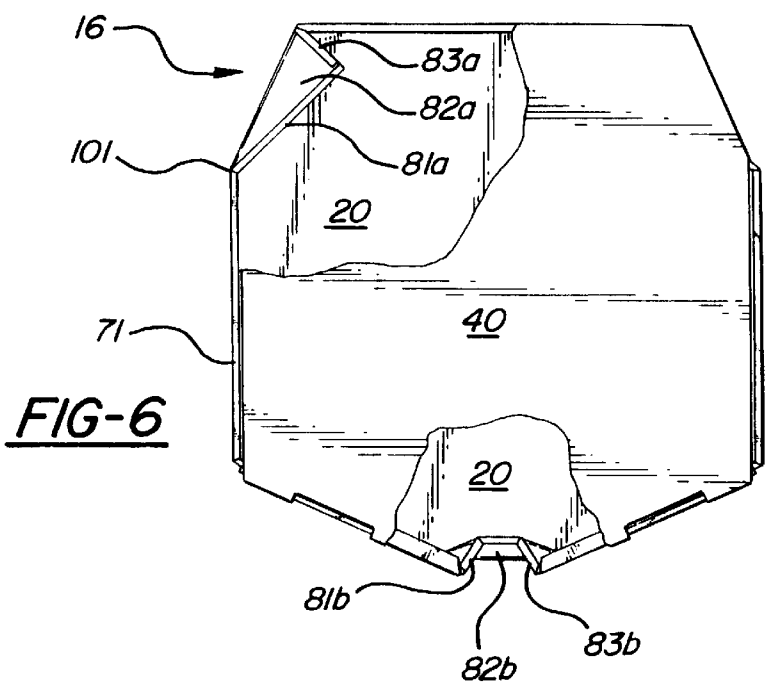
FIG. 6 is a top view of a closed carton formed from the blank of FIG. 4, with the three angle-changeable wall structures being in second disposition.
Figure 5:
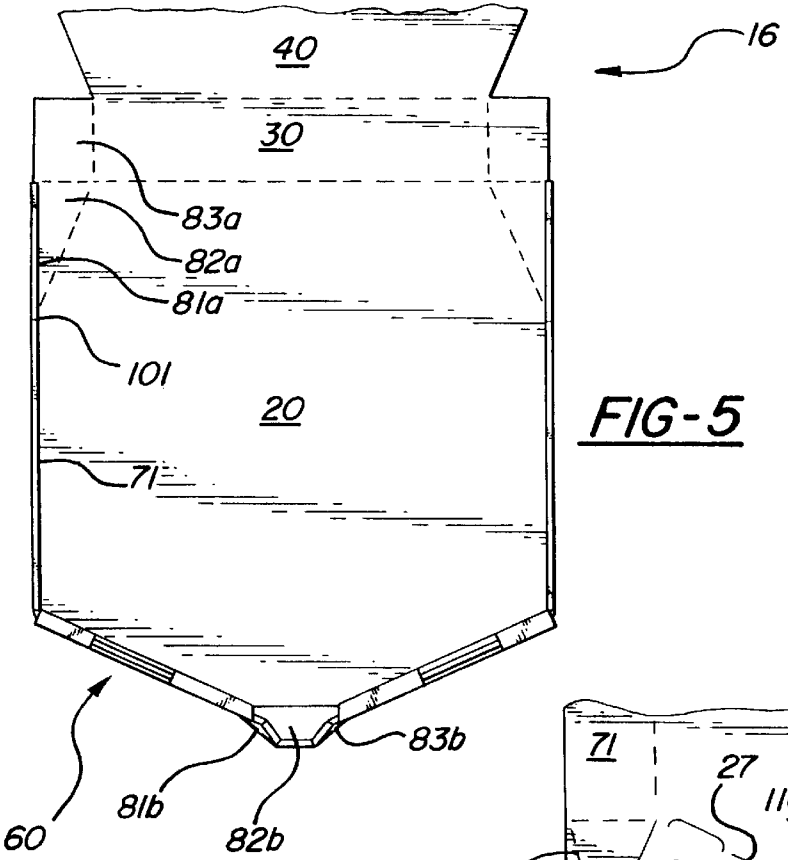
FIG. 5 is a top view of an open carton formed from the blank of FIG. 4, with the three angle-changeable wall structures being in first disposition.
Figure 7:
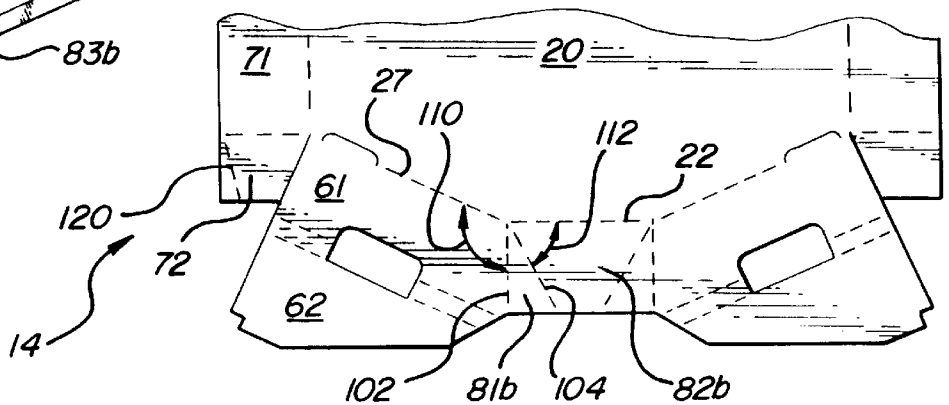
FIG. 7 is a plan view of a section of the blank of the second preferred embodiment.

FIGS. 1, 2, 3 show the first embodiment, with FIG. 1 showing a blank 10 and FIGS. 2 and 3 showing open and closed formats, respectively, of a box 12 which is derived from blank 10. FIGS. 4, 5, 6 show the second embodiment, with FIG. 4 showing a blank 14 and FIGS. 5 and 6 showing open and closed formats, respectively, of a box 16 which is derived from blank 14. FIG. 7 shows a section of blank 14.

It is noted that the invention is bilaterally symmetrical. Therefore, for simplicity of description and enumeration, some of the components that appear on both sides of the box may be indicated by numerals on only one side of a drawing. However, it is to be understood that any discussion and numerical reference to one component also applies to the corresponding component on the other side of the box, even though that component may not be specifically referenced with a numeral.

In the drawings, similar structural elements of an embodiment share the same number but have different alphabetic suffixes. Corresponding elements between embodiments and between drawings share a same reference numeral.

Structure of the Invention

Referring now to the first embodiment and specifically to blank 10 (FIG. 1), there is a non-rectangular bottom panel 20 which has a rear end edge 21, a front end edge 22, opposing left and right side edges 23, 24, opposing left and right rear diagonal edges 25, 26, and opposing left and right front diagonal edges 27, 28.

An angle 29 exists between edges 23 and 27 and between edges 24 and 28. Angle 29 is an oblique angle (specifically an obtuse angle of 115 degrees).

A rear wall panel 30 is hingedly attached to bottom panel 20.

A cover panel 40 is hingedly attached to panel 30 and has opposing side edges 41, 42 and opposing front diagonal edges 43, 44. Cover side flaps 45, 46 are hingedly attached to edges 41, 42, respectively, and cover front diagonal flaps 47, 48 are hingedly attached to opposing edges 43, 44, respectively.

The left side of the box cavity is formed by a roll-over expandable wall section 50*a*. As used herein, a "roll-over expandable wall section" is a special wall section comprising (1) a roll-over wall structure, (2) a single-panel wall structure, and (3) an angle-changeable wall structure. A roll-over expandable wall section is the essence of this invention. The three component structures of a roll-over expandable wall section can be arranged in two differing configurations: the first configuration being with the single-panel wall structure as the middle component of the wall section and the second configuration being with the roll-over wall structure as the middle component. In both configurations, the angle-changeable wall structure is an end component.

Roll-over expandable wall section 50*a*, which represents the first configuration, is comprised of roll-over wall structure 60, single-panel wall structure 70, and angle-changeable wall structure 80*a*.

Roll-over wall structure 60 comprises an outer panel 61 hingedly attached to bottom panel 20 and an inner panel 62 hingedly linked by double parallel fold lines to a top edge of panel 61. Wall structure 60 contains a cover interlock means 63 which, in the embodiment, is a knock-out section, or slot, for receiving cover front diagonal flap 47 after blank 10 has been erected into a box. In the box format, a bottom edge tab 64 of inner panel 62 engages in a slot 65 and, thereby, holds panel 62 substantially parallel to panel 61.

Single-panel wall structure 70 comprises a wall panel 71 and a corner flap panel 72 hingedly attached to an end of panel 71. In the box format, corner flap panel 72 is at least partially enclosed between panels 61, 62. This forms a corner between single-panel wall structure 70 and roll-over wall structure 60, thereby holding roll-over expandable wall section 50*a* in a permanently-upright position.

Angle-changeable wall structure 80*a* comprises first, second, and third movable panels 81*a*, 82*a*, and 83*a*, respectively. First movable panel 81*a* is the connecting panel with the rest of the roll-over expandable wall section. It is hingedly attached at a fold line to an end of wall panel 71 (the end being indicated by reference numeral 101). Second movable panel 82*a* is hingedly attached to first movable panel 81*a* and to bottom panel 20. And third movable panel 83*a* is hingedly attached to second movable panel 82*a* and to adjacent wall panel 30. Together, panels 81*a*, 82*a*, and 83*a*are referred to as a plurality of foldline-connected movable panels because the panels are connected one to another by fold lines and, in the open box format, are simultaneously movable from a first disposition to a second disposition and vice versa. It is noted that first and third movable panels 81*a* and 83*a* are free of attachment to bottom panel 20.

It is further noted that first movable panel 81*a* has an end edge 106 that is free of attachment. In the blank format (FIG. 1), end edge 106 is substantially aligned with a bottom edge 108 of third movable panel 83*a*. In the box format (FIG. 2), edge 106 is disposed substantially perpendicular to edge 108.

Although not marked in the drawings, the right side of the box cavity is formed by another roll-over expandable wall section which has a roll-over wall structure, single-panel wall structure, and angle-changeable wall structure that structurally correspond to structures 60, 70, and 80*a* of wall section 50*a*.

In the first embodiment, a front wall panel 90 is attached to bottom panel 20. Corner flap panels 91, 92 are hingedly attached to opposing ends of panel 90. In the box format, each of panels 91 and 92 is enclosed between the inner and outer panels of one of the adjacent roll-over wall structures (60), thereby holding panel 90 in a permanently-upright position.

Referring now to the second embodiment and specifically to blank 14 (FIG. 4), it can be seen that the second embodiment is identical to the first embodiment except that front wall panel 90 of blank 10 has been replaced by angle-changeable wall structure 80*b*. As such, structure 80*b* is disposed between opposing wall panels 61 and is hingedly attached at a fold line to each. Further, structure 80*b* comprises a plurality of three foldline-connected movable panels 81*b*, 82*b*, and 83*b*.

This type of structure, which consists of a plurality of three foldline-connected movable panels disposed between two front diagonal wall panels and hingedly attached thereto, is disclosed in my U.S. Pat. No. 5,553,771 (Resource Saving Box), issued Sep. 10, 1996. Referring to FIG. 1 in that patent, the plurality of three foldline-connected movable panels is constituted by panels 103*a*, 45, and 103*b*, and the opposing front diagonal wall panels are 43*a* and 43*b*.

The result of combining angle-changeable wall structure 80*b* with roll-over wall structure 60 and single-panel wall structure 70 is roll-over expandable wall section 50*b*. This section represents the second configuration of roll-over expandable wall section. (In the first configuration represented by section 50*a*, single-panel wall structure 70 is the middle component; in the second configuration represented by section 50*b*, roll-over structure 60 is the middle component.) In the second configuration, angle-changeable wall structure 80*b* is attached to outer panel 61.

Because of its alternate shape and location, structure 80*b* can appear to differ from structure 80*a*. However, in actuality structure 80*b* is the same as structure 80*a* in structure, function, operation, and result, as explained in the following discussion.

The first, second, and third movable panels (81*b*, 82*b*, 83*b*) of structure 80*b* correspond respectively to the first, second, and third movable panels of structure 80*a*. Specifically, the first movable panel (81*b*) is the connecting panel with the rest of the roll-over expandable wall section. In the case of section 50*b*, the first movable panel is hingedly attached to an end of outer panel 61 (the end being indicated by reference numeral 102). The second movable panel (82*b*) is hingedly attached to the first movable panel and to bottom panel 20. And the third movable panel (83*b*) is hingedly attached to the second movable panel and to the adjacent wall panel (in this case the outer panel of the adjacent roll-over wall structure). As can be seen, this is exactly the same structural arrangement as occurs in structure 80*a*.

In addition, as with structure 80*a*, the movable panels of structure 80*b* constitute a plurality of foldline-connected movable panels because they are connected one to another by fold lines and, in the open box format, they are simultaneously movable from a first disposition to a second disposition and vice versa (FIGS. 5 and 6). Finally, as with panels 81*a* and 83*a*, panels 81*b* and 83*b* are free of attachment to bottom panel 20. In short, the structure of structure 80*b* is fundamentally the same as that of structure 80*a*.

Structures 80*a* and 80*b* are also functionally alike. Specifically, each can be put into either of two dispositions, called first and second dispositions. The first disposition is an "outward" disposition that results in a box cavity of expanded size and the second disposition is an "inward" disposition that results in a box cavity of contracted size. (The first disposition of each structure can be seen in FIG. 5, which shows box 16 in open format. The second disposition can be seen in FIG. 6, which shows the same box in closed format).

Structures 80*a* and 80*b* also operate similarly, or perform the above function in similar manner. Because each angle-changeable wall structure is attached both to a permanently-upright wall panel (71 or 61) and to another fixed panel (e.g., bottom panel 20), each angle-changeable wall structure has a slight built-in resistance to movement that causes it to tend to remain in whichever of the two dispositions that it is in. In other words, deliberate pressure is required to move each of the angle-changeable wall structures from the first disposition to the second disposition and vice versa. Because of the built-in resistance, the movement of each wall structure occurs with a kind of flipping or snapping effect.

Finally, the functioning of structures 80*a* and 80*b* produces a similar effect, or same result. Specifically, by putting each structure into the first disposition it creates a larger-size box cavity that, in turn, can facilitate a functional advantage such as easier box-loading or in-box pizza-cutting. By putting each structure into the second disposition it creates a smaller-size box cavity that, in turn, can provide a structural advantage such as enhanced box rigidity, tighter cover closure, or greater stacking strength. In conclusion, structures 80*a* and 80*b* have similar structure, function, operation, and result.

In the second embodiment there exists angles 110 and 112. Referring to FIG. 7, angle 110 is between edges (or fold lines) 27 and 102, with edge 27 being the bottom edge and edge 102 being the forward end edge of panel 61. This angle is an obtuse angle of 115 degrees. Angle 112 is between edges (or fold lines) 22 and 104, with edge 22 being the bottom edge and edge 104 being the side edge of panel 82*b*. This angle is an acute angle of 60 degrees. The degrees of these two angles can be adjusted to change the shape, positioning, or resistance-to-movement of structure 80*b*. A similar effect can be achieved with structure 80*a* by changing the angles between fold lines of the movable panels in that structure, as well.

Methods of Use

The essence of the following methods is disclosed in my application Ser. No. 08/311,396 (Convertible Box), now U.S. Pat. No. 5,713,509, and my application Ser. No. 08/731,586 (Multi-function Pizza Carton), which is a continuation of application Ser. No. 08/311,396.

A recommended method for erecting blank 10 into box 12 is as follows. First, fold wall panel 90 to upright position. Second, using both hands, grasp left and right wall panels 71 near the front end and simultaneously fold them to upright position followed by folding corner flap panels 72 inward. Third, while still holding panels 71 at the front end, simultaneously fold left and right outer panels 61 to upright position using your thumbs. Fourth, fold left and right inner panels 62 downward and lock them into place, thereby enclosing panels 72 between panels 61 and 62. At this point, roll-over wall structure 60 and single-panel wall structure 70 on each side of the box will be locked in permanently-upright position, left and right angle-changeable wall structures 80*a* will be in first (or outward) disposition, and cover panel 40 will be laid back. This is the open format of the box (FIG. 2). Fifth, move structures 80*a* into second (or inward) disposition by pushing movable panels 81*a*/82*a* inward. The result will be a snapping or flipping effect as each structure 80*a* changes disposition. Simultaneously, the cover panel will rise slightly upward. Finally, close cover panel 40 onto the box, fold cover flaps 45, 46 inward and inside the box cavity and tuck cover flaps 47, 48 inside slots 63 in roll-over wall structures 60. This is the closed format of the box (FIG. 3), at which point the box might be stacked for use later.

A recommended method for erecting blank 14 into box 16 is as follows. First, using both hands, grasp left and right wall panels 71 near the front end and simultaneously fold them to upright position followed by folding corner flap panels 72 inward. Second, while still holding panels 71 at the front end, simultaneously fold left and right outer panels 61 to upright position using your thumbs. Third, fold left and right inner panels 62 downward and lock them into place, thereby enclosing panels 72 between panels 61 and 62. At this point, roll-over wall structure 60 and single-panel wall structure 70 on each side of the box will be locked in permanently-upright position, angle-changeable wall structures 80*a* and 80*b* will be in first (or outward) disposition, and cover panel 40 will be laid back. This is the open format of the box (FIG. 5). Fourth, move structures 80*a* and 80*b* into second (or inward) disposition by pushing movable panels 81*a*/82*a* and 81*b*/82*b* inward. The result will be a snapping or flipping effect as each structure 80*a*, 80*b* changes disposition. Finally, close cover panel 40 onto the box, fold cover flaps 45, 46 inward and inside the box cavity and tuck cover flaps 47, 48 inside slots 63 in roll-over wall structures 60. This is the closed format of the box (FIG. 6), at which point the box might be stacked for use later.

For loading pizza into the box and for in-box pizza-cutting, the following method of use is recommended. First, open the cover of the box and lay it back. Second, expand the box cavity to maximum size by moving angle-changeable wall structures 80*a* and 80*b* from second disposition to first disposition. Third, load a pizza into the box. Having an expanded box cavity for pizza-loading is handy if the pizza has been sliced prior to loading, as it reduces the chance of the box walls "catching" pizza slices as the pizza is being slid into the box. Fourth, if the pizza has not been sliced prior to loading, slice it inside the box with a pizza cutter. Having an expanded box cavity for in-box pizza-cutting is handy because it provides more room for rolling the pizza cutter all the way to the edge of the pizza. Fifth, move angle-changeable wall structures 80*a* and 80*b* back into second disposition. Finally, close the cover.

As an optional feature, wall panel 71 and roll-over wall structure 60 can be made to slope slightly outward, or partially-recline, when the box is in open format. This feature can facilitate box-loading and in-box pizza-cutting. To install the feature, an alternate downward-sloping top edge 120 of corner flap panel 72 is used, as indicated by the dashed line in FIG. 7. Further information on designing this feature and also on fall-back-wall retention cover flaps can be found in my application Ser. No. 08/731,586 (Multi-function Pizza Carton).

In addition, it is noted that partially-erected open boxes can be nested one inside the other to conserve space if structures 80*a*/80*b* are put into the first disposition. This method is disclosed in my U.S. Pat. No. 5,713,509 (Convertible Box).

Definition of Key Terms

Within this specification and the ensuing claims, certain key terms are used. To provide clear meaning, those terms are defined by the following discussion. The definitions mostly relate to the box format, as opposed to the blank format, of the invention.

A "roll-over expandable wall section" is a wall section comprising three particular contiguous wall structures: (1) a roll-over wall structure, (2) a single-panel wall structure, and (3) an angle-changeable wall structure. There are two configurations that a roll-over expandable wall section can assume. The first configuration is with the single-panel wall structure as the middle component of the section (example FIG. 1). The second configuration is with the roll-over wall structure as the middle component (example FIG. 4). In both configurations, the angle-changeable wall structure is an end component of the section. Because of a corner-connection between the roll-over wall structure and the single-panel wall structure, a roll-over expandable wall section remains in a permanently-upright position. Because of the angle-changeable wall structure, a roll-over expandable wall section can be adjusted to provide a box cavity of expanded size and of contracted size.

A "roll-over wall structure" is a wall structure comprising substantially parallel inner and outer panels hingedly linked along a top edge.

A "single-panel wall structure" is a wall structure comprising a wall panel and at least one corner flap panel hingedly attached to an end of the wall panel. The corner flap panel is at least partially disposed between the inner and outer panels of the roll-over wall structure.

An "angle-changeable wall structure" is a wall structure comprising a plurality of foldline-connected movable panels. "Foldline-connected movable panels" are panels that are joined at fold lines and are movable from one disposition to another. In a roll-over expandable wall section, the first movable panel of the plurality is hingedly attached to either the single-panel wall structure or the roll-over wall structure. At least one other movable panel in the plurality is hingedly attached to another panel of the box. A unique feature of an angle-changeable wall structure is that it can be moved from a first disposition to a second disposition and vice versa: the first disposition resulting in an expanded, or larger-size, box cavity and the second disposition resulting in a contracted, or smaller size, box cavity. In moving between dispositions, the angle between movable panels changes. Thus, the panels change position relative to each other and also relative to an adjacent wall structure.

"Open format" refers to a box having an opened cover, so that the box is open at the top (FIGS. 2, 5). "Closed format" refers to a box having a closed cover, so that the box is closed at the top (FIGS. 3, 6).

A "non-rectangular box" is a box having more than four walls. A "non-rectangular bottom panel" is a bottom panel having more than four distinct edges or angles.

A "non-collapsible box" is a box that has at least one permanently-upright wall structure. A "permanently-upright wall structure" is a wall structure that will retain an upright position even when the box is in open format and even when the wall structure receives a slight outwardly push. A "collapsible box" is a box that has no permanently-upright wall structures. In such a box, all the wall structures can be easily pushed to a fully-reclined position, or coplanar with the bottom panel, when the box is in open format.

An "expandable box" is a box that has at least one wall structure that can be moved from one disposition to another resulting in the box cavity being expanded and contracted in size.

A "partially-reclined wall" is a wall that angles slightly outward but still retains an upright position (in other words, is not fully-reclinable). A "fixed panel" is a panel that stays relatively in the same position when the box goes from closed format to open format. Typical fixed panels are the bottom panel of a box and a permanently-upright wall panel or wall structure. An example of a panel that is not a permanently-upright wall panel would be the rear wall panel of the embodiments disclosed herein.

The term "hingedly attached" refers to one panel being joined to another panel at a fold line.

A fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a box. Such an offset slit may be referred to herein as a "slot-forming slit." Nonetheless, the entire combination of long and short slits is considered to constitute a single fold line unless otherwise indicated.

In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a non-rectangular, non-collapsible, expandable box that has a roll-over expandable wall section comprising a roll-over wall structure, a single-panel wall structure, and an angle-changeable wall structure. The angle-changeable wall structure is movable from a first disposition to a second disposition and vice versa. As such, there is a particular method of use associated with the box. The first disposition results in a box cavity of expanded size, which can possibly provide a certain functional advantage such as easier box-loading or easier in-box pizza-cutting, and the second disposition results in a box cavity of contracted size, which can possibly provide a structural advantage such as enhanced box rididity, tighter cover closure, or greater stacking strength.

The illustrated number, size, shape, type, and placement of components represent the preferred embodiments; however, many other combinations and configurations are possible within the scope of the invention.

For example, the number, size, shape and placement of the movable panels in an angle-changeable wall structure can differ from that shown in the embodiments, and such would be considered to be within the scope of the invention. Examples of other configurations of angle-changeable wall structures are disclosed in my application Ser. No. 09/061,302 (Designer Pizza Box with Enhancements), my application Ser. No. 08/589,892 (Product-protecting Pizza Carton), my application Ser. No. 08/731,586 (Multi-function Pizza Carton), and my application Ser. No. 08/311,396 (Convertible Box), now U.S. Pat. No. 5,713,509. Those angle-changeable wall structures differ one from another and also from the angle-changeable wall structures disclosed herein.

Also, the number of roll-over expandable wall sections can differ from that shown in the embodiments. Specifically, the first and second preferred embodiments have at least two roll-over expandable wall sections. However, it's possible to have a box that has only one roll-over expandable wall section. Such a box would be considered to be within the scope of the invention.

Throughout the discussion, reference has been made to packaging pizza. However, it is noted that my invention can be used for packaging other foods and for other applications, as well.

In conclusion, it is understood that my invention is not to be limited to the disclosed embodiments but, on the contrary, is intended to cover various modifications and equivalent arrangements included within the spirit and scope of the appended claims.

I claim:

1. A non-rectangular, non-collapsible, expandable box comprising a non-rectangular bottom panel and at least one roll-over expandable wall section;

said at least one roll-over expandable wall section comprising:

(a) a roll-over wall structure comprising an outer panel attached to said bottom panel and an inner panel hingedly linked to a top edge of said outer panel and disposed substantially parallel to said outer panel, (b) a single-panel wall structure comprising a wall panel attached to said bottom panel and a corner flap panel attached to an end of said wall panel, said corner flap panel being at least partially enclosed between said inner and outer panels, (c) an angle-changeable wall structure comprising a plurality of foldline-connected movable panels including a first movable panel hingedly attached to one of said outer panel and said wall panel, said angle-changeable wall structure being movable from a first disposition to a second disposition and vice versa when said box is in an open format, said first disposition resulting in a box cavity of expanded size and said second disposition resulting in a box cavity of contracted size.

2. The box of claim 1 wherein:

said plurality of foldline-connected movable panels also is hingedly attached to a panel other than said one of said outer panel and said wall panel.

3. The box of claim 1 wherein:

an oblique angle exists between said outer panel and said wall panel.

4. The box of claim 3 wherein:

said plurality of foldline-connected movable panels further includes a second movable panel hingedly attached to said first movable panel and to said bottom panel.

5. The box of claim 4 wherein:

said plurality of foldline-connected movable panels further includes a third movable panel hingedly attached to said second movable panel.

6. The box of claim 5 wherein:

said first and third movable panels are free of attachment to said bottom panel.

7. The box of claim 6 wherein:

said plurality of foldline-connected movable panels consists of said first, second, and third movable panels.

8. The box of claim 7 wherein:

said third movable panel also is hingedly attached to another panel.

9. The box of claim 8 wherein:

said one of said outer panel and said wall panel is said wall panel, said first movable panel has an end edge free of attachment, said end edge being disposed substantially perpendicular to a bottom edge of said third movable panel.

10. The box of claim 8 wherein:

said one of said outer panel and said wall panel is said outer panel, said second movable panel has a bottom edge and first and second side edges each disposed at an acute angle to said bottom edge.

11. The box of claim 8 wherein:

said one of said outer panel and said wall panel is said outer panel, said outer panel has a forward end edge and a bottom edge, said forward end edge being disposed at an oblique angle to said bottom edge.

12. A non-rectangular, non-collapsible, expandable pizza box comprising:

(a) a non-rectangular bottom panel, (b) a rear wall panel attached to said bottom panel, (c) a cover panel attached to said rear wall panel, (d) first and second roll-over wall structures respectively comprising first and second outer panels attached to said bottom panel and first and second inner panels hingedly linked to a top edge of said first and second outer panels and disposed substantially parallel to said first and second outer panels, (e) first and second single-panel wall structures respectively comprising first and second wall panels attached to said bottom panel and first and second corner flap panels attached to an end of said first and second wall panels, said first and second corner flap panels being at least partially enclosed between the first inner and outer panels and the second inner and outer panels, respectively, (f) an angle-changeable wall structure comprising a plurality of foldline-connected movable panels including:

(i) a first movable panel hingedly attached to one of the first outer panel, second outer panel, first wall panel, and second wall panel, said first movable panel being free of attachment to said bottom panel, (ii) a second movable panel hingedly attached to said first movable panel and to said bottom panel, (iii) a third movable panel hingedly attached to said second movable panel, said third movable panel being free of attachment to said bottom panel;

whereby said box has at least one roll-over expandable wall section comprised of one of said first and second roll-over wall structures, one of said first and second single-panel wall structures, and said angle-changeable wall structure.

13. A blank for a non-rectangular, non-collapsible, expandable box, said blank being cut and scored to define a non-rectangular bottom panel and at least one roll-over expandable wall section;

said at least one roll-over expandable wall section comprising:

(a) a roll-over wall structure comprising an outer panel attached to said bottom panel and an inner panel hingedly linked to a top edge of said outer panel, whereby after said blank has been erected into a box said inner panel is disposed substantially parallel to said outer panel, (b) a single-panel wall structure comprising a wall panel attached to said bottom panel and a corner flap panel attached to an end of said wall panel and disposed adjacent said roll-over wall structure, whereby after said blank has been erected into said box said corner flap panel is at least partially enclosed between said inner and outer panels, (c) an angle-changeable wall structure comprising a plurality of foldline-connected movable panels including a first movable panel hingedly attached to one of said outer panel and said wall panel, said angle-changeable wall structure being movable from a first disposition to a second disposition and vice versa after said blank has been erected into an open box, said first disposition resulting in a box cavity of expanded size and said second disposition resulting in a box cavity of contracted size.

14. The blank of claim 13 wherein:

said plurality of foldline-connected movable panels also is hingedly attached to a panel other than said one of said outer panel and said wall panel.

15. The blank of claim 13 wherein:

said outer panel and said wall panel are attached to said bottom panel at an outer panel bottom edge and a wall panel bottom edge, respectively, an oblique angle exists between said outer panel bottom edge and said wall panel bottom edge.

16. The blank of claim 15 wherein:

said plurality of foldline-connected movable panels further includes a second movable panel hingedly attached to said first movable panel and to said bottom panel.

17. The blank of claim 16 wherein:

said plurality of foldline-connected movable panels further includes a third movable panel hingedly attached to said second movable panel.

18. The blank of claim 17 wherein:

said first and third movable panels are free of attachment to said bottom panel.

19. The blank of claim 18 wherein:

said plurality of foldline-connected movable panels consists of said first, second, and third movable panels.

20. The blank of claim 19 wherein:

said third movable panel also is hingedly attached to another panel.

21. The blank of claim 20 wherein:

said one of said outer panel and said wall panel is said wall panel, said first movable panel has an end edge free of attachment, said end edge being substantially aligned with a bottom edge of said third movable panel.

22. The blank of claim 20 wherein:

said one of said outer panel and said wall panel is said outer panel, said second movable panel has a bottom edge and first and second side edges each disposed at an acute angle to said bottom edge.

23. The blank of claim 20 wherein:

said one of said outer panel and said wall panel is said outer panel, said outer panel has a forward end edge and a bottom edge, said forward end edge being disposed at an oblique angle to said bottom edge.

* * * * *